United States Patent [19]

Sullaway

[11] 4,151,875

[45] May 1, 1979

[54] EZ DISPOSAL PACKER

[75] Inventor: Bob L. Sullaway, Duncan, Okla.

[73] Assignee: Halliburton Company, Duncan, Okla.

[21] Appl. No.: 860,013

[22] Filed: Dec. 12, 1977

[51] Int. Cl.[2] ..... E21B 33/129

[52] U.S. Cl. ..... 166/126; 166/133; 166/134; 166/325

[58] Field of Search ..... 166/123, 126, 133, 134, 166/148, 151, 325

[56] References Cited

U.S. PATENT DOCUMENTS

| | | | |
|---|---|---|---|
| 2,117,535 | 5/1938 | Baker et al. | 166/133 X |
| 2,578,900 | 12/1951 | Ragan | 166/133 X |
| 2,589,506 | 3/1952 | Morrisett | 166/123 |
| 3,163,225 | 12/1964 | Perkins | 166/123 |
| 3,385,370 | 5/1968 | Knox et al. | 166/325 X |
| 3,698,411 | 10/1972 | Garrett | 166/325 X |
| 3,967,679 | 7/1976 | Liljestrand | 166/325 X |

*Primary Examiner*—Stephen J. Novosad
*Assistant Examiner*—George A. Suchfield
*Attorney, Agent, or Firm*—John H. Tregoning; James R. Duzan

[57] ABSTRACT

Packer for use in the disposal of abrasive fluids and well debris from a well drilling operation comprising: a packer mandrel; an upper slip support slidable on the packer mandrel; an upper slip wedge installed on the packer mandrel; a first plurality of slips; an elastomeric packer assembly installed on the packer mandrel; a lower slip wedge installed on the packer mandrel; a lower slip support; a second plurality of slips; a valve cage having a valve stem guide retained within the bore of the lower slip support; and a valve means having a stem slidable within the valve stem guide of the valve cage, the valve means being operable between a first position preventing and a second position allowing the flow of abrasive fluid and well debris through the bore of the lower slip support.

10 Claims, 2 Drawing Figures

EZ DISPOSAL PACKER

This invention relates to an improved packer for wells and more specifically to an improved packer for the disposal of drilling mud and well debris after the completion of a dry hole in a well drilling operation.

With the advent of strict environmental control laws limiting the manner in which drilling mud and debris from a well drilling operation may be disposed after the completion of a dry hole, it has become desirable to develop a packer capable of withstanding the flow of large volumes of highly abrasive drilling mud and well debris at high flow rates therethrough while being easy to set in the wellbore and will not leak upon closure.

Currently existing packers designed for use in well cementing operations or well testing operations are unsatisfactory for use for the disposal of large volumes of drilling mud and well debris at high flow rates since they are not constructed of abrasion resistant materials thereby causing high rates of packer erosion, since they have small internal bores thereby causing high fluid flow velocities therethrough with resultant high packer erosion rates or since they have closure valve arrangements which require the fluids pumped through the packer valve to flow transverely of the direction of fluid flow in the wellbore or closure valve arrangements located in the packer mandrel reducing the fluid flow area at the closure valve thereby causing high packer closure valve erosion rates with attendant closure valve leakage.

In contrast to the prior art, the present invention is a packer designed for the disposal of large volumes of drilling mud and well debris at high flow rate therethrough comprising fluid flow parts constructed of abrasion resistant materials, a large internal bore for low fluid flow velocities therethrough and a closure valve arrangement which causes a minium of fluid flow disturbance by being located aft of the packer mandrel.

Figure 1:
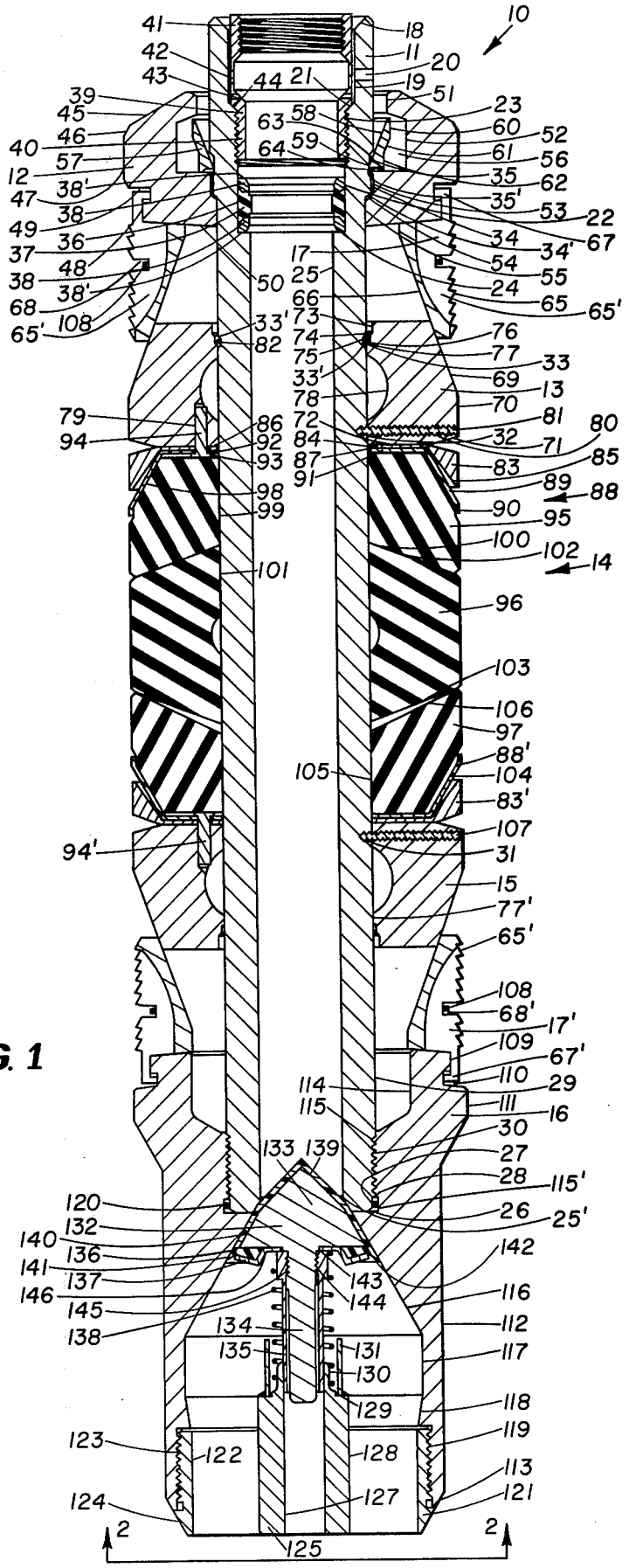
FIG. 1 is a cross-sectional view of the invention.

Referring to FIG. 1, the invention is shown in its preferred embodiment.

The packer 10 comprises a packer mandrel 11, upper slip support 12, upper slip wedge 13, packer assembly 14, lower slip wedge 15, lower slip support 16 and slips 17 and 17'.

The packer mandrel 11 comprises an elongate unitary tubular member. The interior surface of the packer mandrel 11 comprises a chamfered inlet 18, a first bore 19 terminating in an annular seat 21, a second bore 22 having a threaded upper end 23 and terminating at its lower end at annular shoulder 24, and a central bore 25 terminating in a chamfered annular surface 25'. The exterior surface of the packer mandrel 11 comprises a lower annular face 26, a first cylindrical portion 27 having an annular shoulder 28, a second cylindrical portion 29 having a threaded section 30, having a plurality of circumferentially threaded holes 31 in the lower portion thereof, having a plurality of circumferentially spaced threaded holes 32 and having an annular channel 33 in the upper portion thereof, and a third cylindrical portion 34 having an annular channel 35 formed therein and having annular chamfered shoulder 34' thereon. The packer mandrel 11 may be formed of any relatively high hardness steel alloy to resist erosion, although any suitable material may be used.

Contained within bore 22 of the packer mandrel 11 is an internal seal means 36 comprising an elastomeric member 37 secured to metal annular members 38. When initially installed in bore 22 of the packer mandrel 11, the internal seal means 36 is installed having an annular face 38' abutting shoulder 24 of the packer mandrel 11.

Also installed in the packer mandrel 11 is a tension sleeve 39. The tension sleeve 39 comprises an annular member having an external threaded portion 40, an internally threaded portion 41, a reduced thickness portion 42 and a plurality of holes 43 which allow fluid communication between the interior and exterior of the tension sleeve 39.

When installed in the packer mandrel 11 the tension sleeve 40 has externally threaded portion 39 engaging threaded portion 23 of bore 22 with annular chamfer 44 abutting annular seat 21 of the packer mandrel 11. The reduced thickness portion 42 is formed such that upon the application of a predetermined axial load applied from above through internally threaded portion 41 of the tension sleeve 39, the tension sleeve 39 will separate at the reduced thickness portion 42. Although the tension sleeve 39 may be formed of any suitable metal, brass is preferred.

The upper slip support 12 comprises an annular collar. The exterior of the slip support 12 comprises a first annular chamfered surface 45, second annular chamfered surface 46, first cylindrical surface 47, second cylindrical surface 48 having an annular channel 49 therein, and lower surface 50. The interior of the slip support 12 comprises a first bore 51, a second bore 52, a third bore 53, annular chamfered seat 54 and a forth bore 55. The second bore 52 is of greater diameter than first bore 51 and third bore 53 thereby forming a cavity 56 in which lock ring 57 is carried. The upper slip support 12 may be formed of any suitable material, although soft cast iron is preferred.

Lock ring 57 comprises a split annular ring having a conically shaped interior surface 58 terminating in a cylindrical portion 59 at the lower end thereof while the exterior surface is formed of a first cylindrical portion 60, a conically shaped portion 61 and a second cylindrical portion 62. The lower end face 63 of the lock ring 57 has a recess 64 formed therein so that only a portion of the lower end face 63 abuts upper slip support 12 when the lock ring 57 is installed in recess 56 of the upper slip support 12. The lock ring 57 can be formed of any suitable metal, although aluminum is preferred.

When installed on the packer mandrel 11, the upper slip support 12 is installed with annular chamfered seat 54 abutting annular chamfered shoulder 34' on the packer mandrel 11 and with lock ring 57 installed in annular channel 35 of the packer mandrel 11 with end face 63 of the lock ring 57 abutting the wall of recess 56 in the upper slip support 12. As installed, the upper slip support 12 is prevented from upward movement on the packer mandrel 11 since annular chamfered seat 54 abuts annular chamfered shoulder 34' on packer mandrel 11 while only limited downward movement of the upper slip support is permitted since lock ring 57 will abut a wall of recess 56 and recess 64 of the end face 63 will abut wall 35' of annular channel 35 in packer mandrel 11.

The slips 17 comprise arcuate shaped members having a serrated cylindrical exterior surface 65 interrupted by one or more arcuate shaped longitudinal slots 65', a generally conically shaped interior surface 66, and an attachment lip 67. The serrated cylindrical exterior surface 65 of each slip 17 contains a circumferential channel 68. Each slip 17 is supported at one end by the upper slip support 12 by means of the attachment lip 67 of the slip 17 mating with annular channel 49 of the upper slip support 12. The other end of the slip 17 is supported by the upper slip wedge 13. Although the slips 17 may be made of any suitable material, hard cast iron is preferred.

The upper slip wedge 13 comprises an annular collar having an exterior surface comprising a first conically shaped portion 69 terminating in a cylindrical portion 70 which, in turn, terminates in a second conically shaped portion 71 having an end face 72, and an interior surface comprising a first bore 73 terminating in an annular chamfered seat 74, a second bore 75 terminating in a shoulder 76 and a third bore 77 having an annular arcuate shaped recess 78 located therein. The first conically shaped portion 69 of the exterior surface of the upper slip wedge 13 is formed at a conical angle substantially the same as the conical angle of the conically shaped interior surface 66 of the slip 17 to allow the slip 17 to be cammed outwardly upon relative movement between the slip 17 and the upper slip wedge 13. The upper slip wedge 13 is formed with a plurality of axial holes 79 in the end face 72 and a plurality of threaded circumferentially spaced holes 80 which extend from the cylindrical portion 70 of the exterior surface to bore 77 of the interior surface. The upper slip wedge 13 may be formed of any suitable material, but soft cast iron is preferred.

The upper slip wedge 13 is retained on the packer mandrel 11 by a plurality of machine screws 81 which engage threaded holes 80 in the upper slip wedge 13 and threaded holes 32 in the packer mandrel 11. Upper end of the upper slip wedge 13 is centered about packer mandrel 11 by means of snap ring 82 installed in abutting engagement with shoulder 76 at the termination of bore 75 of the slip wedge 13. The snap ring 82 is preferably installed with an edge abutting a chamfered annular side wall 33' of annular channel 33 in the packer mandrel 11 to facilitate the centering of the upper slip wedge 13 about the packer mandrel 11 and to prevent premature setting of the slips 17 when inserting the packer 10 in a wellbore. The snap ring 82 may be formed of any suitable resilient material.

Abutting end face 72 of upper slip support 13 is a back-up ring 83 which serves as a back-up for the packer assembly 14 during the compression thereof. The back-up ring 83 comprises an annular collar having a central bore 84, conically shaped interior surface 85 and a plurality of holes 86 spaced about a reduced thickness portion 87. The back-up ring 83 is formed from brass, although any suitable material may be used.

Abutting the reduced thickness portin 87 of the back-up ring 83 is a packer shoe 88. The packer shoe 88 comprises a generally conically shaped member having a conically shaped portion 89, cylindrical end portion 90 and central portion 91 having a bore 92 and a plurality of holes 93 therethrough. The packer shoe 88 serves as a bearing surface during the compression of the packer assembly 14. Similar to the back-up ring 83, the packer shoe 88 is formed of brass material, although any suitable material may be used.

To prevent rotation of the back-up ring 83 and packer shoe 88, a plurality of pins 94 are inserted into holes 79 of the upper slip support 13 via holes 86 in backup ring 83 and holes 93 in packer shoe 88.

The packer assembly 14 comprises an upper packer element 95, a center packer element 96 and a lower packer element 97. The upper packer element 95 is formed with a conically shaped exterior surface portion 98 which mates with packer shoe 88, with a bore 99 through which packer mandrel 11 extends and with an angularly shaped, with respect to the horizontal axis of the packer element, lower end face 100 which abuts packer element 96. The center packer element 96 is formed with a bore 101 through which packer mandrel 11 extends and with angularly shaped, with respect to the horizontal axis of the packer element, end faces 102 and 103 which abut upper packer element 95 and lower packer element 97 respectively. The lower packer element 97 is formed with a conically shaped exterior surface portion which mates with packer shoe 88', with a bore 105 through which packer mandrel 11 extends and with an angularly shaped, with respect to the horizontal axis of the packer element, upper face 106 which abuts face 103 of center packer element 96.

The angles at which the abutting end faces 100, 102 and 103, 106 of the packer elements 95, 96 and 97 respectively are constructed with respect to the horizontal axes of the elements vary depending upon the type of elastomeric material from which the packer elements are formed. For example, if the packer elements 95, 96 and 97 are formed of BUNA-N type rubber, the angular end faces 100, 102 and 103 of the packer elements 95 and 96 respectively are formed at a 15 degree angle while end face 106 of the packer element 97 is formed at a 20 degree angle. Although the packer elements 95, 96 and 97 may be formed of any suitable elastomeric material, BUNA-N type rubber is preferred. It should be noted that unless the packer elements are formed with the proper angular relationship, the packer assembly will not evenly expand upon compression loading.

The packer shoe 88' and back-up ring 83' are identical in construction to the packer shoe 88 and back-up ring 83 described hereinbefore, and, therefore, will not be described in detail.

It should be noted that the back-up rings 83, 83' and packer shoes 88, 88' are installed on either side of the packer assembly 14 to prevent the extrusion of the packer assembly 14 over either the upper slip wedge 13 or lower slip wedge 15 during high axial loading conditions on the packer 10.

Similarly, the lower slip wedge 15 is identical to the upper slip wedge 14 described hereinbefore, and therefore, will not be described in detail. However, it should be noted that one end of lower slip wedge 15 is secured by a plurality of threaded members 107 engaging threaded holes 31 in packer mandrel 11 while the other end of lower slip wedge 15 is centered by bore 77' on the packer mandrel 11.

Slips 17' are identical to slips 17 described hereinbefore, with each slip 17' having one end supported on the lower slip wedge 15 while the other end of the slip 17' is supported in an annular channel in cylindrical portion of the lower slip support 16.

To retain the slips 17 and 17', each slip having one end resting on the appropriate slip wedge with the other end being supported in the appropriate annular channel, cylindrical metal bands 108 which are rectangular in cross section are installed in channel 68 or 68' of the slips 17 or 17'. Upon setting of the packer 10, the metal bands 108 are broken to allow the slips 17 or 17' to engage the wellbore.

The lower slip support 16 comprises a member having a generally cylindrical exterior surface and an irregularly shaped interior surface. The exterior surface of the lower slip support 16 comprises a first cylindrical portion 109 having an annular channel 110 located therein, a second cylindrical portion 111, a third cylindrical portion 112 and terminating in a conically shaped portion 113.

The interior surface of the lower slip support 16 comprises a first cylindrical bore 114, a first threaded bore 115 terminating in an annular channel 115', a first conical bore 116, a second cylindrical bore 117, a second conical bore 118 and a second threaded bore 119. The lower slip support 16 is secured to the packer mandrel 11 by means of the first threaded bore 115 engaging threaded section 30 of the packer mandrel 11. An elastomeric O-ring seal 120, retained in the cavity formed by annular channel 115' of the lower slip support 16 and cylindrical portion 26 having annular shoulder 28 of the packer mandrel 11, prevents fluid leakage from the interior of the packer mandrel 11 and lower slip support 16.

Figure 2:
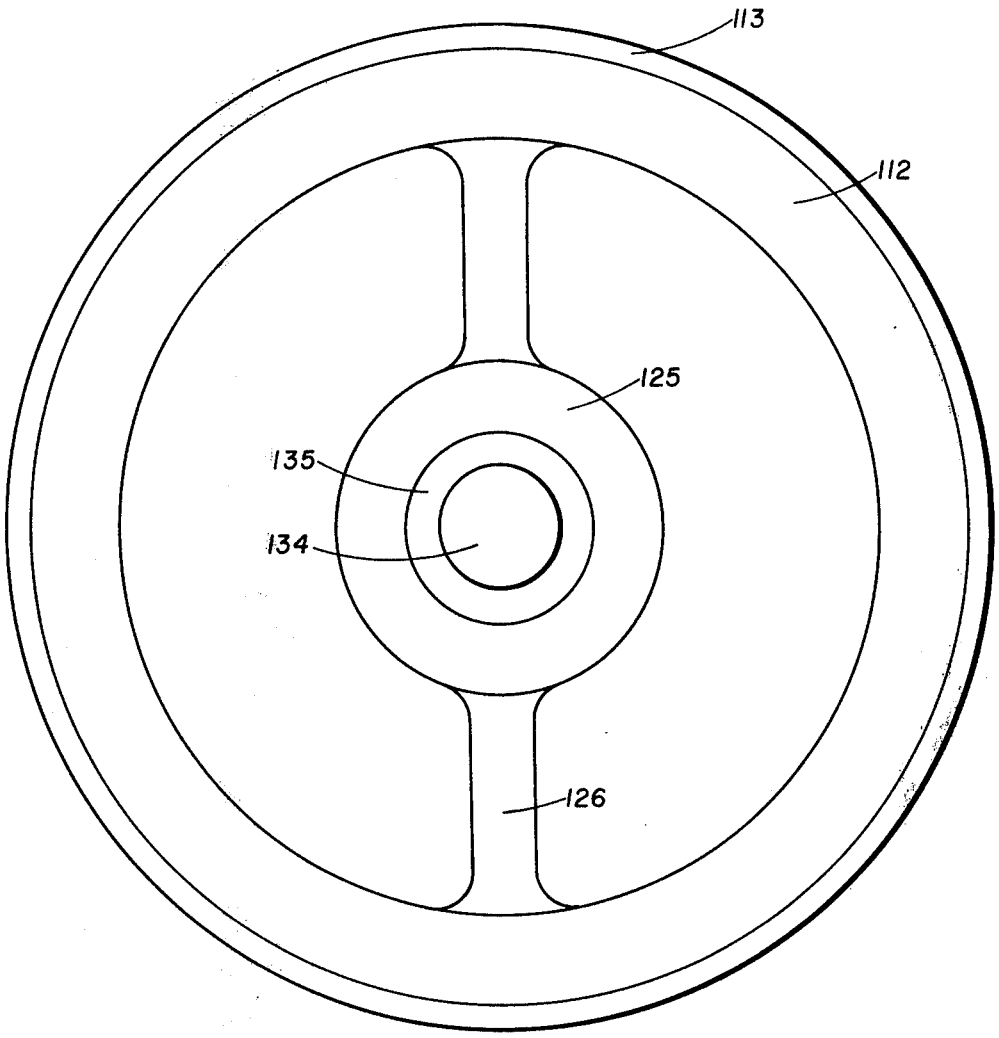
FIG. 2 is a view along line 2—2 of FIG. 1 showing the lower end of the invention in full view.

Retained in the lower end of the slip support 16 is a valve cage 121. The valve cage 121 comprises a generally cylindrical member having a bore 122, an exteriorly threaded portion 123 which mates with threaded bore 119 of the lower slip support 16, a conical portion 124 which abuts and is formed at the same conical angle as conical portion 113 of the lower slip support 16, valve guide 125 and valve guide supports 126 (see FIG. 2). The valve guide 125 comprises a cylindrical member having an internal bore 127 and on the exterior a first cylindrical portion 128, an annular shoulder 129, a second cylindrical portion 130, and having a sleeve 131 secured to the cylindrical member at annular shoulder 129 by any suitable manner, such as by welding. The valve cage 121 and valve guide 125 is formed of mild hardness steel, although any suitable material may be used.

Retained within internal bore 127 of valve guide 125 is the valve stem 134 of valve member 132. Valve member 132 comprises a valve head 133 having a protective coating thereon, a valve stem 134, valve stem protector 135, valve member seal 136, valve member seal washer 137, and valve spring 138. The valve head 133 of the valve member 132 comprises a first conically shaped portion 139 and a second conically shaped portion 140 which mates with conical bore 116 of the lower slip support 16 to prevent the flow of fluid therethrough when biased into engagement therewith by valve spring 138. The valve member seal 136 comprises an elastomeric member having a conically shaped exterior surface 141 which mates with conical bore 116 of the lower slip support 16 to prevent the flow of fluid therethrough from below when the valve member 132 is biased into engagement with bore 116, and an irregularly shaped interior surface which mates with valve member seal washer 137. The valve member seal washer 137 comprises an irregularly shaped circular washer having a bore 143 therethrough. The valve member seal washer 137 pilots on valve stem 34 and is biased into engagement with valve member seal 136 by valve spring 138. The valve stem protector 135 surrounds the valve stem 134 throughout its length to protect the valve stem 134 from damage when sliding in the bore 127 of the valve guide 125. The valve stem protector 135 is secured to the valve stem 134 of the valve member 132 by threadedly engaging threaded portion 144 of the valve stem 134 by way of threaded portion 145 of the valve stem guide 135. One end of the valve spring 138 is centered with respect to the valve seal member washer 137 by the exterior surface of threaded portion 145 of the valve stem guide 135 while the other end is centered on the valve guide 125 by engaging second cylindrical portion 130 of the valve guide 125. When compressed, the valve spring 138 is retained in an aligned stacked arrangement about valve stem protector 135 and the second cylindrical portion 130 of the valve guide 125 by sleeve 131. The sleeve 131 further serves as an abuttment means for bearing against valve seal member washer 137 when the valve member 132 is open and fluid is flowing thereover to prevent wobbling of the valve stem 134 in bore 127 of valve guide 125. The irregularly shaped surface of the valve seal member washer 137 contains a conically shaped portion 146 which serves as a centering means to center the valve head 133 of the valve member 132 when the valve seal member washer 137 abuts the sleeve 131. Although the valve stem 134 has been shown having a protector 135 thereon, the valve stem 134 could be formed as a unitary member having the diameter of the combined valve stem and protector with the valve stem protector being, therefore, unnecessary.

The valve member 132 is preferably formed of hard steel with the valve head 133 having a protective coating of polyurethane thereon, although any suitable materials may be used which are at least as erosion resistant. The valve spring 138 is formed of spring steel while the valve seal member 132 is preferably rubber, although any suitable elastomeric material may be used, and with the valve stem protector 135 being formed of mild steel in conjunction with the valve seal member washer 137.

To set the packer 10 in a wellbore, a setting tool is inserted into the bore of the packer mandrel 11 so that a portion of the setting tool sealingly engages internal seal means 36 and another portion of the setting tool threadedly engages threaded portion 41 of tension sleeve 39. At this time the upper slips 17 are engaged with the wellbore by a tubular sleeve of the setting tool engaging lock ring 57 to expand the lock ring so that the tubular sleeve of the setting tool ultimately abuts the lower wall of cavity 56 of the upper slip support 12. Continued advancement of the tubular sleeve of the setting tool causes the upper slip support 12 to be advanced downwardly along the packer mandrel 11 thereby causing the slips 17 to advance along upper slip wedge 13 and to be cammed into engagement with the wellbore. When the slips 17 are being cammed into engagement with the wellbore, the band 108 is broken thereby allowing the slips 17 to freely engage the wellbore.

After the upper slips 17 have been engaged with the wellbore, the packer assembly 14 and lower slips 17' are forced into engagement with the wellbore by pulling on the setting tool which threadedly engages threaded portion 41 of the tension sleeve 39 which, in turn, is secured to the packer mandrel 11. By pulling on the packer mandrel 11 through tension sleeve 39 the lower slips 17' are cammed into engagement with the wellbore when the band 108 is broken while continued pulling on the packer mandrel 11 through tension sleeve 39 subsequently causes the screws 81 and 107 to be sheared thereby releasing the upper slip wedge 13 and lower slip wedge 15 respectively to compress the packer assembly 14 therebetween. As the packer mandrel 11 is moved upward, the upper slip wedge 13 cams slips 17 more tightly into engagement with the wellbore, the slips 17' moving along lower slip wedge 15 are cammed tightly into engagement with the wellbore and the movement of the upper 13 and lower 15 slip wedges along the packer mandrel causes the packer assembly 14 to be compressed tightly into sealing engagement with the wellbore. At a predetermined force the reduced thickness portion 42 of the tension sleeve 39 is severed by overstressing of the material thereby causing any relative movement between the upper slip support 12 and the packer mandrel 11 to cease. At this time the packer 10 is retained in the wellbore with the packer assembly 14 sealingly engaging the wellbore by the slips 17 or 17' having their serrated surfaces 65 or 65' respectively engaging the wellbore thereby preventing any relative movement of the upper 12 or lower 16 slip supports. By selecting a tension sleeve 39 having the proper reduced thickness portion 42 at which the tension sleeve will be sheared by the application of a force to the packer mandrel 11, damage to the wellbore by the slips 17 and to the packer assembly 14 through the overcompression thereof is prevented.

After the setting of the packer 10 in the wellbore, the packer is ready for the pumping of highly abrasive fluids and well debris therethrough. To pump fluid through the packer 10, a tube is inserted into the bore 25 of the packer mandrel 11 and is sealingly engaged by elastomeric member 37 of the internal seal means 36. Upon the initiation of highly abrasive fluid flow and well debris through the packer 10, the highly abrasive fluid and well debris flows into the bore 25 of the packer mandrel 11, opens valve member 132 flowing over the valve head 133, and exits the packer 10 by flowing out bore 122 of the valve cage 121. Since the packer mandrel is formed as an elongated unitary tubular member having an uninterrupted bore 25 therethrough and is formed of hard steel having good erosion resistant properties, the abrasive fluid and well debris flow velocity through the bore 25 of the packer mandrel and the erosive effects of the abrasive fluid and well debris are significantly lower than the abrasive fluid and well debris flow velocity and erosive effects through the internal bore of a packer having a valve seat and accompanying valve located in the packer mandrel thereby restricting the flow area of the packer mandrel.

By locating the valve member 132 in the lower slip support 16, the packer mandrel 11 is formed with the largest possible bore 25 when considering the maximum allowable stress levels in the packer mandrel 11. Another desirable effect of locating the valve member 132 in the lower slip support 16 results when the valve member 132 is fully opened since the abrasive fluid flow area is nearly constant past the valve head 133 and greatly increases once past the valve head thereby minimizing the erosive effects of the abrasive fluid and well debris flow with respect to the valve head 133 over that of a packer having a valve member in the packer bore which requires the abrasive fluid flow to accelerate when passing the valve member thereby accentuating the erosive effects of the abrasive fluid flow.

In this connection, the erosive effects of the abrasive fluid flow are minimized regarding the valve member 132 by constructing the valve member 132 of hard erosion resistant steel and applying a protective coating, such as polyurethane, to the valve head 133 of the valve member 132. It is extremely critical that the valve head 133 not be eroded by the abrasive fluid flow since this is the sole means of preventing fluid flow from the wellbore when the packer 10 is installed therein.

The packer 10 offers the further advantage of being removable from the wellbore after the setting of the packer 10 therein by milling techniques. By constructing only the internal parts of the packer 10 of erosion resistant hard steel while the external parts of the packer are constructed of brass, mild hardness steel or cast iron, the packer may be removed by milling techniques thereby allowing the wellbore to be reopened.

Regarding packer durability, in typical disposal operations, abrasive fluids and well debris from well drilling operations have been pumped through a packer 10 in varying volumes and flow rates from 21,250 barrels of abrasive fluid and well debris at an average flow rate of 15 barrels per minute to 37,920 barrels of abrasive fluid and well debris at an average flow rate of 4 barrels per minute without any apparent deterioration of the packer's ability to seal the wellbore upon the completion of the disposal operation. In laboratory tests, pumping only abrasive fluid, as much as 85,950 barrels of abrasive fluid have been pumped through a packer 10 at an average flow rate of 10 barrels per minute without severe erosion of the packer components in contact with the abrasive fluid.

While the foregoing is a description of the packer described in the preferred embodiment, those skilled in the art and familiar with the disclosure of the invention may recognize certain additions, deletions, substitutions or other modifications which would fall within the purview of the invention as defined in the claims.

What is claimed is:

1. A packer for use in the disposal of abrasive fluids and well debris from a well drilling operation comprising:

a packer mandrel comprising an inlet portion having bore means therethrough and a remaining portion having an uninterrupted central bore therethrough, the length of the inlet portion of said packer mandrel being small in relation to the length of the remaining portion of said packer mandrel, said packer mandrel formed of material which is resistant to the erosion thereof by the flow of said abrasive fluids and said well debris therethrough;

an upper slip support slidable on said packer mandrel;

an upper slip wedge installed on said packer mandrel;

a first plurality of slips, each slip of said first plurality of slips having one end retained by said upper slip support while the other end slidably engages said upper slip wedge;

an elastomeric packer assembly installed on said packer mandrel;

a lower slip wedge installed on said packer mandrel;

a lower slip support having a bore therethrough aligned with the bore in said packer mandrel and secured to one end of said packer mandrel, the bore in said lower slip support comprising:

a first portion secured to one end of said packer mandrel;

a second portion having the inlet thereof communicating with the uninterrupted central bore of said packer mandrel and being substantially equal in diameter to the uninterrupted central bore of said packer mandrel; and a remaining portion communicating with the outlet of the second portion of the bore in said lower slip support;

a second plurality of slips, each slip of said second plurality of slips having one end retained by said lower slip support while the other end slidably engages said lower slip wedge;

a valve cage having a valve stem guide, said valve cage retained within the remaining portion of the bore in said lower slip support and having a bore therethrough with the inlet diameter thereof being substantially equal in diameter to the outlet diameter of the second portion of the bore in said lower slip support; and valve means comprising valve head means formed of material which is resistant to the erosion thereof by the flow of said abrasive fluids and said well debris thereover and valve stem means slidable within the valve stem guide of said valve cage, said valve means operable between a first position preventing the flow of abrasive fluid and well debris through the bore of said lower slip support by said valve means sealingly engaging a portion of the second portion of the bore in said lower slip support and a second position allowing the flow of abrasive fluid and well debris through the bore of said lower slip support and said valve cage whereby the velocity of the flow of said abrasive fluid and said well debris over the valve head means of said valve means in said lower slip support substantially equals the velocity of the flow of said abrasive fluid and said well debris in the uninterrupted central bore in said packer mandrel when said valve means is in the second position in said lower slip support thereby allowing the flow of said abrasive fluid and said well debris through the bore of said lower slip support and said valve cage from said packer mandrel.

2. The packer of claim 1 wherein:

the second portion of the bore in said lower slip support comprises a conically shaped sealing surface for said valve means; and said valve means further comprises an abrasion resistant coating on the valve head means and a spring biasing the valve head means into engagement with the conically shaped sealing surface of the second portion of the bore in said lower slip support.

3. The packer of claim 2 wherein said valve means further comprises:

a valve means seal having a conically shaped exterior surface which is formed at substantially the same conical angle as the conically shaped sealing surface of the second portion of the bore in said lower slip support; and a valve means seal washer biased into engagement with the surface of said valve means seal by said spring thereby biasing said valve means seal into engagement with the valve head means of said valve means.

4. The packer of claim 3 wherein:

the abrasion resistant coating on the valve head means of said valve means comprises polyurethane; and said upper slip support, said upper wedge, said slips, said elastomeric packer; said lower slip wedge and said lower slip support are formed of millable materials.

5. A packer for use in the disposal of abrasive fluids and well debris from a well drilling operation comprising:

a packer mandrel comprising an inlet portion having bore means therethrough and a remaining portion having an uninterrupted central bore therethrough, the length of the inlet portion of said packer mandrel being small in relation to the length of the remaining portion of said packer mandrel, said packer mandrel formed of material which is resistant to the erosion thereof by the flow of said abrasive fluids and said well debris therethrough;

an upper slip support formed of millable material and slidable on said packer mandrel;

an upper slip wedge formed of millable material and installed on said packer mandrel;

a first plurality of slips formed of millable material, each slip of said first plurality of slips having one end retained by said upper slip support while the other end rests upon said upper slip wedge;

an elastomeric packer assembly installed on said packer mandrel;

a lower slip wedge formed of millable material and installed on said packer mandrel;

a lower slip support formed of millable material and having a bore therethrough aligned with the bore in said packer mandrel and secured to one end of said packer mandrel, the bore in said lower slip support comprising:

a first portion secured to one end of said packer mandrel;

a second conically shaped portion having the inlet thereof communicating with the uninterrupted central bore of said packer mandrel and being substantially equal in diameter to the uninterrupted central bore of said packer mandrel; and a remaining portion communicating with the outlet of the second portion of the bore in said lower slip support;

a second plurality of slips formed of millable material, each slip of said second plurality of slips having one end retained by said lower slip support while the other end slidably engages said lower slip wedge;

a valve cage having a valve stem guide, said valve cage retained within the remaining portion of the bore in said lower slip support and having a bore therethrough with the inlet diameter thereof being substantially equal in diameter to the outlet diameter of the second portion of the bore in said lower slip support; and valve means comprising valve head means having an abrasion resistant polyurethane coating thereon and valve stem means integrally attached thereto slidable within the valve stem guide of said valve cage, the valve head means and the valve stem means formed of material which is resistant to the erosion thereof by the flow of said abrasive fluids and said well debris thereover, a valve member seal, a valve member seal washer engaging a surface of the valve member seal, and a spring biasing said valve means into engagement with the second conically shaped portion of the bore in said lower slip support, said valve means operable between a first position preventing the flow of said abrasive fluid and said well debris through the bore of said lower slip support by said valve means sealingly engaging a portion of the second conically shaped portion of the bore in said lower slip support and a second position allowing the flow of said abrasive fluid and said well debris through the bore of said lower slip support and said valve cage whereby the velocity of the flow of said abrasive fluid and said well debris over the valve head means of said valve means in said lower slip support substantially equals the velocity of the flow of said abrasive fluid and said well debris in the uninterrupted central bore in said packer mandrel when said valve means is in the second position in said lower slip support thereby allowing the flow of said abrasive fluid and said well debris through the bore of said lower slip support and said valve cage from said packer mandrel.

6. A packer for use in the disposal of abrasive fluids and well debris from a well drilling operation, said packer including a packer mandrel, an upper slip support, an upper slip wedge, a plurality of upper slips, an elastomeric packer assembly, a lower slip wedge, a lower slip support, a plurality of lower slips, a valve cage and valve means, wherein the improvement in said packer comprises:

said packer mandrel comprising an inlet portion having bore means therethrough and a remaining portion having an uninterrupted central bore therethrough, the length of the inlet portion of said packer mandrel being small in relation to the length of the remaining portion of said packer mandrel, said packer mandrel formed of material which is resistant to the erosion thereof by the flow of said abrasive fluids and said well debris therethrough;

said lower slip support having a bore therethrough aligned with the bore in said packer mandrel and secured to one end of said packer mandrel, the bore in said lower slip support comprising:

a first portion secured to one end of said packer mandrel;

a second portion having the inlet thereof communicating with the uninterrupted central bore of said packer mandrel and being substantially equal in diameter to the uninterrupted central bore of said packer mandrel; and a remaining portion communicating with the outlet of the second portion of the bore in said lower slip support;

said valve cage having a valve stem guide therein, said valve cage retained within the remaining portion of the bore in said lower slip support and having a bore therethrough with the inlet diameter thereof being substantially equal in diameter to the outlet diameter of the second portion of the bore in said lower slip support; and said valve means comprising valve head means formed of material which is resistant to the erosion thereof by the flow of said abrasive fluids and said well debris thereover and valve stem means slidable within the valve stem guide of said valve cage, said valve means operable between a first position preventing the flow of abrasive fluid and well debris through the bore of said lower slip support by said valve means sealingly engaging a portion of the second portion of the bore in said lower slip support and a second position allowing the flow of abrasive fluid and well debris through the bore of said lower slip support and said valve cage whereby the velocity of the flow of said abrasive fluid and said well debris over the valve head means of said valve means in said lower slip support substantially equals the velocity of the flow of said abrasive fluid and said well debris in the uninterrupted central bore in said packer mandrel when said valve means is in the second position in said lower slip support thereby allowing the flow of said abrasive fluid and said well debris through the bore of said lower slip support and said valve cage from said packer mandrel.

7. The packer of claim 6 wherein the improvement further comprises:

the second portion of the bore in said lower slip support comprises a conically shaped sealing surface for said valve means; and said valve means further comprises an abrasion resistant coating on the valve head means and a spring biasing the valve head means into engagement with the conically shaped sealing surface of the second portion of the bore in said lower slip support.

8. The packer of claim 7 wherein the improvement further comprises:

a valve means seal on said valve means, the valve means having a conically shaped exterior surface which is formed at substantially the same conical angle as the conically shaped sealing surface of the second portion of the bore in said lower slip support; and a valve means seal washer biased into engagement with the surface of said valve means seal by said spring thereby biasing said valve means seal into engagement with the valve head means of said valve means.

9. The packer of claim 8 wherein the improvement further comprises:

the abrasion resistant coating on the valve head means of said valve means comprises polyurethane; and said upper slip support, said upper wedge, said upper slips, said lower slips, said elastomeric packer; said lower slip wedge and said lower slip support are formed of millable materials.

10. A packer for use in a wellbore to control the flow of fluid therethrough, said packer including a packer mandrel, an upper slip support, an upper slip wedge, a plurality of upper slips, an elastomeric packer assembly, a lower slip wedge, a lower slip support, a plurality of lower slips, a valve cage and valve means, wherein the improvement in said packer comprises:

said packer mandrel comprising an inlet portion having bore means therethrough and a remaining portion having an uninterrupted central bore therethrough, the length of the inlet portion of said packer mandrel being small in relation to the length of the remaining portion of said packer mandrel, said packer mandrel formed of material which is resistant to the erosion thereof by the flow of said fluid therethrough;

said lower slip support having a bore therethrough aligned with the bore in said packer mandrel and secured to one end of said packer mandrel, the bore in said lower slip support comprising:

a first portion secured to one end of said packer mandrel;

a second conically shaped portion having the inlet thereof communicating with the uninterrupted central bore of said packer mandrel and being substantially equal in diameter to the uninterrupted central bore of said packer mandrel; and a remaining portion communicating with the outlet of the second portion of the bore in said lower slip support;

said valve cage having a valve stem guide therein, said valve cage retained within the remaining portion of the bore in said lower slip support and having a bore therethrough with the inlet diameter thereof being substantially equal in diameter to the outlet diameter of the second portion of the bore in said lower slip support; and said valve means comprising valve head means having an abrasion resistant polyurethane coating thereon, valve stem means integrally attached thereto slidable within the valve stem guide of said valve cage, a valve member seal, a valve member seal washer engaging a surface of the valve member seal, and a spring biasing said valve means into engagement with the second conically shaped portion of the bore in said lower slip support, said valve means operable between a first position preventing the flow of said fluid through the bore of said lower slip support by said valve means sealingly engaging a portion of the second portion of the bore in said lower slip support and a second position allowing the flow of fluid through the bore of said lower slip support and said valve cage whereby the velocity of the flow of said fluid over the valve head means of said valve means in said lower slip support substantially equals the velocity of the flow of said fluid in the uninterrupted central bore in said packer mandrel when said valve means is in the second position in said lower slip support thereby allowing the flow of said fluid through the bore of said lower slip support and said valve cage from said packer mandrel.

* * * * *